US011053671B2

(12) United States Patent
Childs et al.

(10) Patent No.: US 11,053,671 B2
(45) Date of Patent: Jul. 6, 2021

(54) SINK AND DRAIN FOR SINK

(71) Applicant: Elkay Manufacturing Company, Downers Grove, IL (US)

(72) Inventors: Daniel Keating Childs, Nokomis, FL (US); Shawn Daly, Shorewood, IL (US); Jonathan Chee Yeen Chong, Chicago, IL (US); Erik Lynch, Downers Grove, IL (US); Robert Zudic, Chicago, IL (US); Christopher Waas, North Riverside, IL (US)

(73) Assignee: Elkay Manufacturing Company, Downers Grove, IL (US)

( * ) Notice: Subject to any disclaimer, the term of this patent is extended or adjusted under 35 U.S.C. 154(b) by 0 days.

(21) Appl. No.: 16/853,263

(22) Filed: Apr. 20, 2020

(65) Prior Publication Data

US 2020/0248441 A1 Aug. 6, 2020

Related U.S. Application Data

(63) Continuation of application No. 16/265,647, filed on Feb. 1, 2019, now Pat. No. 10,626,586, which is a continuation of application No. 15/700,928, filed on Sep. 11, 2017, now Pat. No. 10,519,637, which is a continuation-in-part of application No. 14/708,883, filed on May 11, 2015, now Pat. No. 9,783,968, which is a continuation of application No. 13/428,625, filed on Mar. 23, 2012, now Pat. No. 9,057,185.

(60) Provisional application No. 61/490,138, filed on May 26, 2011, provisional application No. 61/467,858, filed on Mar. 25, 2011.

(51) Int. Cl.

| | |
|---|---|
| ***E03C 1/182*** | (2006.01) |
| ***E03C 1/262*** | (2006.01) |
| ***E03C 1/23*** | (2006.01) |
| ***E03C 1/264*** | (2006.01) |

(52) U.S. Cl.

CPC ..... *E03C 1/182* (2013.01); *E03C 1/2306* (2013.01); *E03C 1/262* (2013.01); *E03C 1/264* (2013.01); *Y10T 29/49826* (2015.01)

(58) Field of Classification Search

CPC . E03C 1/182; E03C 1/262; E03C 1/22; A47K 1/14

USPC ..... 4/287, 288, 286, 650

See application file for complete search history.

(56) References Cited

U.S. PATENT DOCUMENTS

| | | | |
|---|---|---|---|
| 4,150,472 | A | 4/1979 | Derain |
| 4,232,407 | A | 11/1980 | Williams |

(Continued)

FOREIGN PATENT DOCUMENTS

| | | | |
|---|---|---|---|
| CN | 1787769 | A | 6/2006 |

OTHER PUBLICATIONS

U.S. Appl. No. 16/265,647, filed Feb. 1, 2019.

(Continued)

*Primary Examiner* — Christine J Skubinna

(74) *Attorney, Agent, or Firm* — Neal, Gerber & Eisenberg LLP; Tanvi Patel; Nawshaba M. Siddiquee

(57) ABSTRACT

Sinks and drains for sinks permitting the attachment of the drain to the sink such that the drain is substantially disposed below the top surface of the sink basin, and such that there is no discernable separation between the base of the sink basin and the drain when viewed from above the sink. A method of making a sink such that there is no discernable separation between the base of the sink basin and the drain when viewed from above the sink.

9 Claims, 21 Drawing Sheets

(56) References Cited

U.S. PATENT DOCUMENTS

| | | | |
|---|---|---|---|
| 4,692,948 | A | 9/1987 | Martin |
| 5,165,118 | A | 11/1992 | Cendrowski |
| 5,318,230 | A | 6/1994 | Ferguson et al. |
| 5,418,983 | A | 5/1995 | Garguillo et al. |
| 5,535,455 | A | 7/1996 | Liu |
| 7,500,626 | B2 | 3/2009 | Berger et al. |
| 7,503,083 | B2 | 3/2009 | Ball |
| 2003/0182721 | A1 | 10/2003 | Li |
| 2010/0095444 | A1 | 4/2010 | Sullivan |

OTHER PUBLICATIONS

U.S. Appl. No. 15/700,928, filed Sep. 11, 2017.
U.S. Appl. No. 14/708,883, filed May 11, 2015.
U.S. Appl. No. 13/428,625, filed Mar. 23, 2012.
Moen® Stainless Steel Sinks, Various Models, Excerpt from Catalog (1986).
Moen® Sani-Sink® Model 22120 Specification (Asserted to be from 1997).
Just Manufacturing Company, Excerpt from Catalog, p. 9 (Aug. 1987).
Just Manufacturing Company, Excerpt from Catalog, p. 13 (Aug. 1988).

SINK AND DRAIN FOR SINK

CROSS-REFERENCE TO RELATED APPLICATIONS

This patent application is a continuation-in-part application of co-pending U.S. patent application Ser. No. 14/708,883, filed May 11, 2015, which is a continuation of U.S. patent application Ser. No. 13/428,625, filed Mar. 23, 2012, now U.S. Pat. No. 9,057,185, which claims the benefit of U.S. Provisional Patent Application Nos. 61/467,858, filed Mar. 25, 2011, and 61/490,138, filed May 26, 2011, all of which are incorporated by reference in their entireties herein.

BACKGROUND

Sinks have drains for permitting water to drain from the sink into a plumbing system. During installation, drains are typically inserted into the interior of the sink basin and dropped into an opening at the base of the basin. The drain has a rim with a diameter exceeding the diameter of the opening such that the rim rests on the top surface of the base of the sink basin. Often, the portion of the base surrounding the opening has a countersink portion such that the rim of the drain is generally flush with the adjacent portion of the base of the sink. Nonetheless, a groove is present between the rim of the drain and the sink base that is difficult to clean and susceptible to bacterial growth. In addition, the presence of the groove is visible to a user and aesthetically unappealing.

BRIEF SUMMARY

Embodiments of sinks and drains for sinks are disclosed herein. The embodiments permit the attachment of a drain to a sink such that the drain is substantially disposed below the top surface of the sink basin, and such that there is no discernable separation between the base of the sink basin and the drain when viewed from above the sink. A method of making a sink is also disclosed wherein there is no discernable separation between the base of the sink basin and the drain when viewed from above the sink.

A sink is described comprising a sink basin having a sidewall and a base in a bottom portion thereof. The base includes a drain opening and a first drain entry portion integrally formed from the base and extending from the bottom portion at the drain opening. A second drain entry portion includes a first end portion with a radially outwardly extending flange configured to connect to the base at the first drain entry portion, and a second end portion opposite the first end portion. A bracket includes a lip configured to engage the flange. A fastener attaches the bracket to the base to thereby hold the first end of the second drain entry portion to the first drain entry portion with the lip engaged with the flange.

A method of making a sink is also described. The method comprises forming a sink basin having a sidewall and a base, the base including a bottom portion and an opening. A first drain entry portion is formed integrally with the base and extending from the bottom portion at the drain opening. A second drain entry portion is provided, the second drain entry portion including a first end portion with a radially outwardly extending flange. A bracket including a lip is positioned into engagement with the flange to hold the flange on the base at the first drain entry portion. The bracket is attached to the base to thereby hold the first end of the second drain entry portion to the first drain entry portion with the lip engaged with the flange.

DETAILED DESCRIPTION

Figure 1:
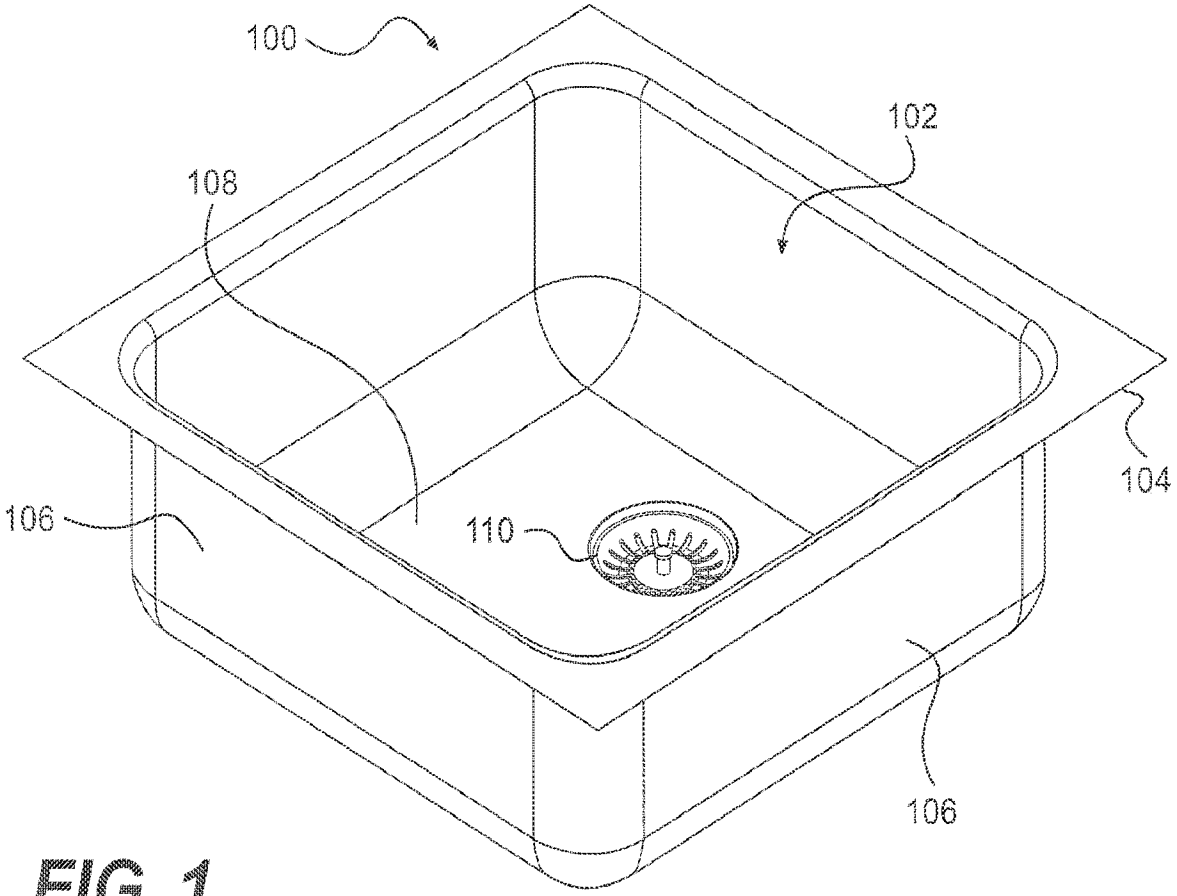
FIG. 1 is a perspective view of a sink.

Referring to FIG. 1, a sink 100 with the appearance of an edgeless drain is shown. The sink 100 can include one or more sink basins 102 and a rim 104. The sink basin 102 can include one or more sidewalls 106 and a base 108. The base 108 can include an opening 110 for a drain. The sidewalls 106 and base 108 can form an interior surface of the basin 102 to retain water and washable items. The rim 104 can be used to support the basin 102 in an above-mount arrangement or under-mount arrangement with respect to a counter. The sink 100 can be made of any suitable material, such as stainless steel.

Figure 2:
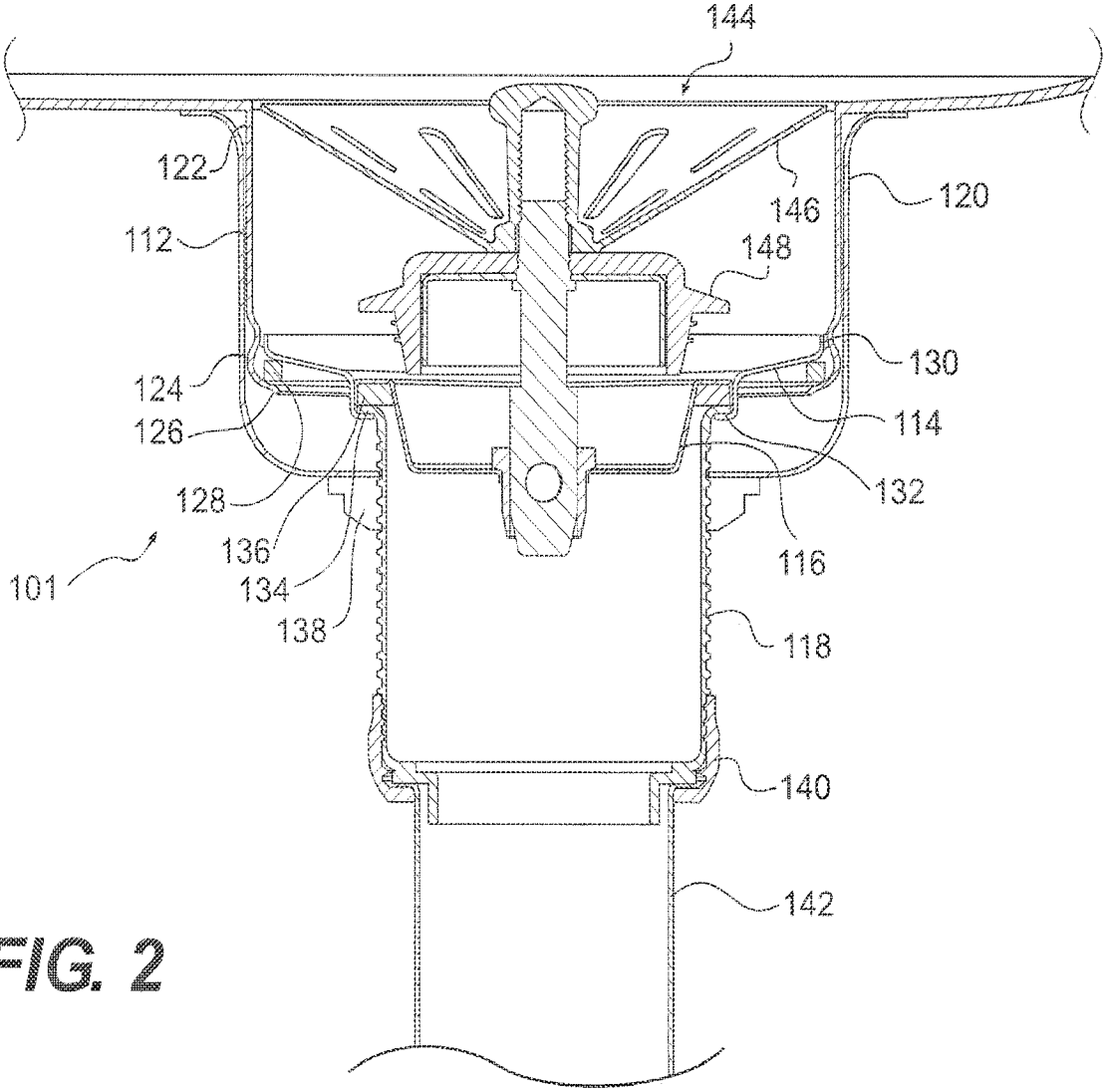
FIG. 2 is a sectional view of a drain for the sink of FIG. 1.

Referring to FIG. 2, a drain 101 is shown that can include a drain entry portion 112, and drain elements including a flange plate 114, a strainer 116, a drain pipe 118, and a cover 120. The drain entry portion 112 can be sized and shaped to receive at least one of the drain elements and preferably all of the above drain elements, for example a cylindrical shape and can extend from the bottom of the sink basin at the opening for the drain 101. The drain entry portion 112 can include a first end portion 122 and a second end portion 124. In some embodiments, the drain entry portion 112 can be formed as part of the sink 100. In other embodiments, the drain entry portion 112 can be a component separately manufactured from the sink 100. The first end portion 122 of the drain entry portion 112 can be welded to the base of the sink to fix the drain entry portion 112 to the sink basin at the opening. In order to conceal the welded intersection between the drain entry portion 112 and the base, a grinding and polishing operation can be applied such that the intersection is hidden to a user looking into the sink basin. In addition, because the drain entry portion 112 can be mounted from below without the need for a drain rim to rest on the base, there is no groove between the drain 101 and the sink basin 102. From a user's perspective, the drain opening leads directly into the drain 101. The weld between the sink basin and the drain entry portion 112 can be accomplished in any suitable manner, such as with a shielding gas weld.

Figure 9:
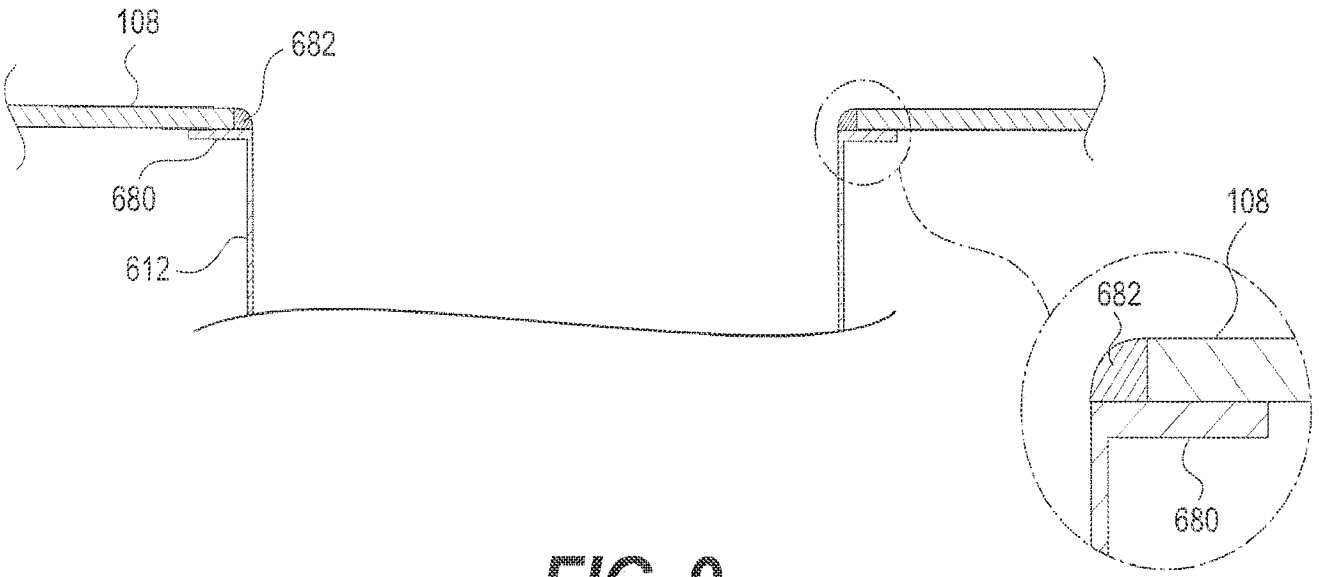
FIG. 9 is a sectional view of a drain entry portion welded to a sink.
Figure 10:
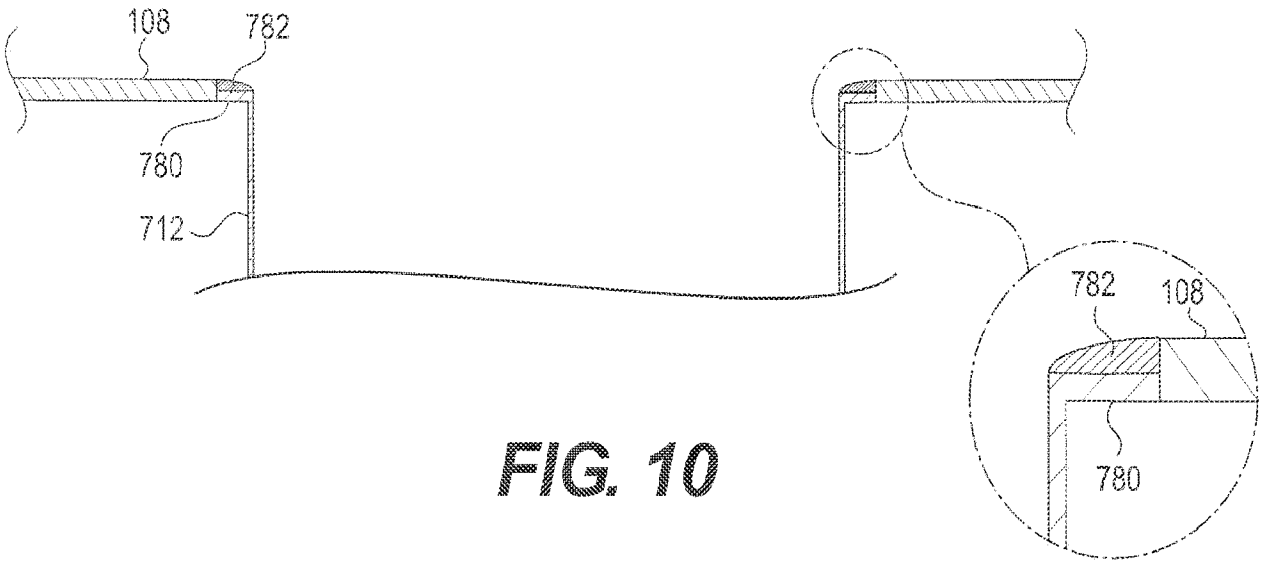
FIG. 10 is a sectional view of another embodiment of a drain entry portion welded to a sink.
Figure 11:
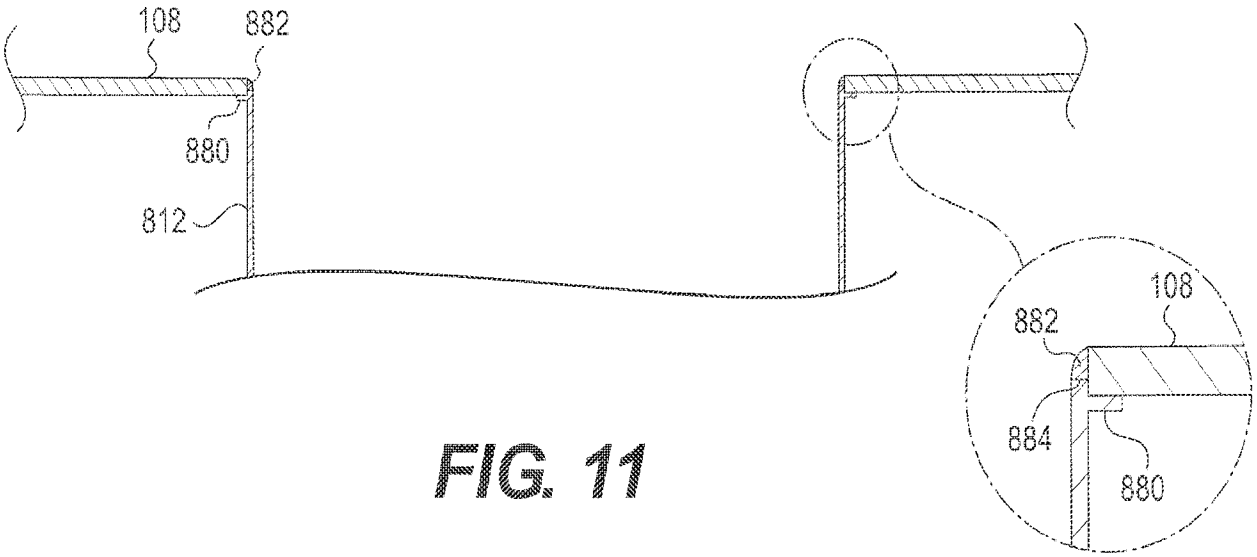
FIG. 11 is a sectional view of a further embodiment of a drain entry portion welded to a sink.

FIGS. 9-11 show examples of suitable embodiments of a drain entry portion welded to a base of a sink. It will be appreciated, however, that the drain entry portion can be coupled to the sink via any suitable manner, some embodiments of which are illustrated herein.

Referring to FIG. 9, the drain entry portion 612 can include a radially extending flange 680. The flange 680 can be disposed against the underside of the sink base 108. The drain entry portion 612 can have an interior diameter that is smaller than the opening 110 of the sink 100 such that there is a portion of the flange 680 extending inward from the opening 110 that can receive a solder material 682 for welding the drain entry portion 612 to the sink 100. As discussed, after welding, a grinding and polishing operation can be applied to the weld such that the intersection between the drain entry portion 612 and the sink 100 is hidden to a user looking into the sink basin 102.

Turning to FIG. 10, the drain entry portion 712 can include a radially extending flange 780. The flange 780 can be disposed within the opening 110 such that the flange abuts the portion of the sink base 108 forming the opening 110. Thus, the perimeter of the flange 780 has a diameter that is smaller than the opening 110 of the sink 100 such that the flange 780 fits within the opening 110. The thickness of the flange 780 can be smaller than the thickness of the sink base 108 such that a space is formed on the upper surface of the flange 780 for receiving a solder material 782 for welding the drain entry portion 712 to the sink 100. As discussed, after welding, a grinding and polishing operation can be applied to the weld such that the intersection between the drain entry portion 612 and the sink 100 is hidden to a user looking into the sink basin 102.

As shown in FIG. 11, the drain entry portion 812 can include a radially extending flange 880. The flange 880 can be disposed away from the edge 884 of the drain entry portion 812 on the first end portion 822. The flange 880 can be disposed against the underside of the sink base 108, and the edge 884 of the drain entry portion 812 can have an exterior diameter that is smaller than the opening 110 of the sink 100. The flange 880 can be located on the drain entry portion 812 a sufficient distance from the edge such that the edge is disposed below the upper surface of the sink base 102 and such that the edge 884 can receive a solder material 882 for welding the drain entry portion 812 to the sink 100. As discussed, after welding, a grinding and polishing operation can be applied to the weld such that the intersection between the drain entry portion 812 and the sink 100 is hidden to a user looking into the sink basin 102.

Referring again to FIG. 2, the second end portion 124 of the drain entry portion 112 can include a lip 126 for receiving a seal 128. The flange plate 114 can have an outer edge portion 130 and an inner edge portion 132. The outer edge portion 130 of the flange plate 114 can rest on the seal 128 such that the seal 128 prevents water inside the drain 101 from passing between the intersection of the drain entry portion 112 and the flange plate 114. The inner edge portion 132 of the flange plate 114 can receive a lip 134 of the drain pipe 118 for supporting the drain pipe 118.

The strainer 116 can be disposed above the lip 134 of the drain pipe 118 and the inner edge portion 132 of the flange plate 114. The strainer 116 can include a seal 136 for contacting the lip 134 of the drain pipe 118 and preventing the passage of water in the drain 101 past the seal 136. The strainer 116 can be press fit within the flange plate 114. The strainer 116 can have one or more openings in the bottom of the strainer to permit water to flow past the strainer 116 and into the drain pipe 118.

The drain 101 can include a cover 120 over the drain entry portion 112, the flange plate 114, and the strainer 116. The cover 120 can be secured to the sink with a locking nut 138. The drain pipe 118 can be threaded to receive the locking nut 138, and the locking nut 138 can be tightened to enhance the seal force applied between the drain entry portion 112 and the flange plate 114. A coupler 140 can be used to attach the drain pipe 118 to a pipe 142 leading to a trap.

A removeable strainer basket 144 can be disposed within the drain 101. The strainer basket 144 can include a basket portion 146 for capturing solids and a stopper 148 that can be lowered into the strainer 114 to plug the drain 101.

Figure 3:
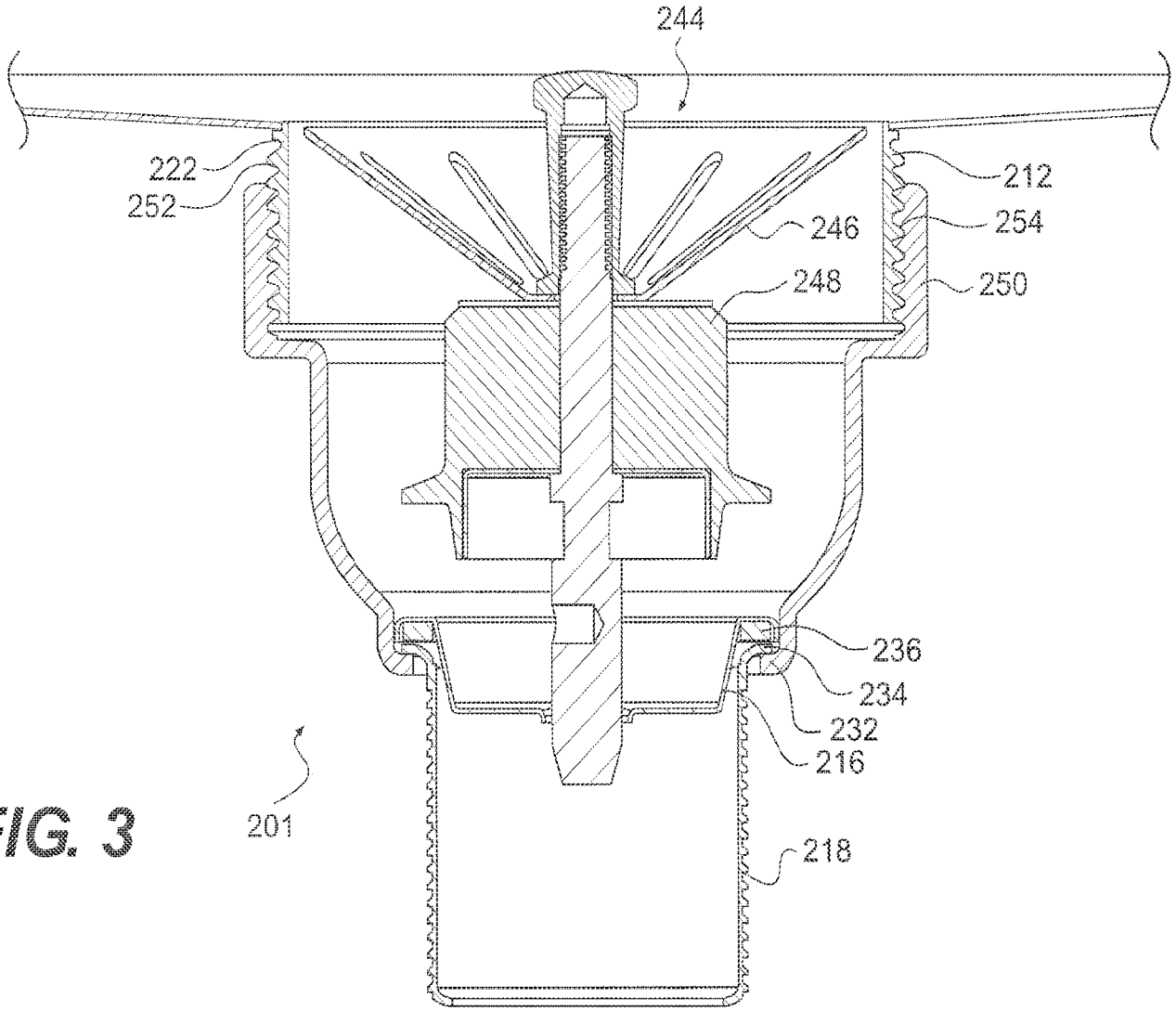
FIG. 3 is a sectional view of a second embodiment of a drain for the sink of FIG. 1.

Turning to FIG. 3, a second embodiment of a drain 201 is shown that can include a drain entry portion 212, and an attachment portion 250, and drain elements including a strainer 216, and a drain pipe 218. The drain entry portion 212 can be cylindrical and can extend from the bottom of the sink basin at the opening for the drain 201. The drain entry portion 212 can include a first end portion 222 and a threaded exterior surface 252. The drain entry portion 212 can be a component separately manufactured from the sink. The first end portion 222 of the drain entry portion 212 can be welded to the base to fix the drain entry portion 212 to the sink basin at the opening. In order to conceal the welded intersection between the drain entry portion 212 and the base, a grinding and polishing operation can be applied such that the intersection is hidden to a user looking into the sink basin. In addition, because the drain entry portion 212 can be mounted from below without the need for a drain rim to rest on the base, there is no groove between the drain 201 and the sink basin. From a user's perspective, the drain opening leads directly into the drain 201. The weld between the sink basin and the drain entry portion 212 can be accomplished in any suitable manner, such as with a shielding gas weld.

The attachment portion 250 can have a threaded surface 254 and an inner edge portion 232. The attachment portion threaded surface 254 can be received and tightened to the threaded surface 252 of the drain entry portion 212. The inner edge portion 232 of the attachment portion 250 can receive a lip 234 of the drain pipe 218 for supporting the drain pipe 218.

The strainer 216 can be disposed above the lip 234 of the drain pipe 218 and the inner edge portion 232 of the attachment portion 250. The strainer 216 can include a seal 236 for contacting the lip 234 of the drain pipe 218 and preventing the passage of water in the drain 201 past the seal 236. The strainer 216 can be press fit within the attachment portion 250. The strainer 216 can have one or more openings in the bottom of the strainer to permit water to flow past the strainer 216 and into the drain pipe 218. The drain pipe 218 can be threaded to receive a coupler that can be used to attach the drain pipe to a pipe leading to a trap.

A removeable strainer basket 244 can be disposed within the drain 201. The strainer basket 244 can include a basket portion 246 for capturing solids and a stopper 248 that can be lowered into the strainer 216 to plug the drain 201.

Figure 4:
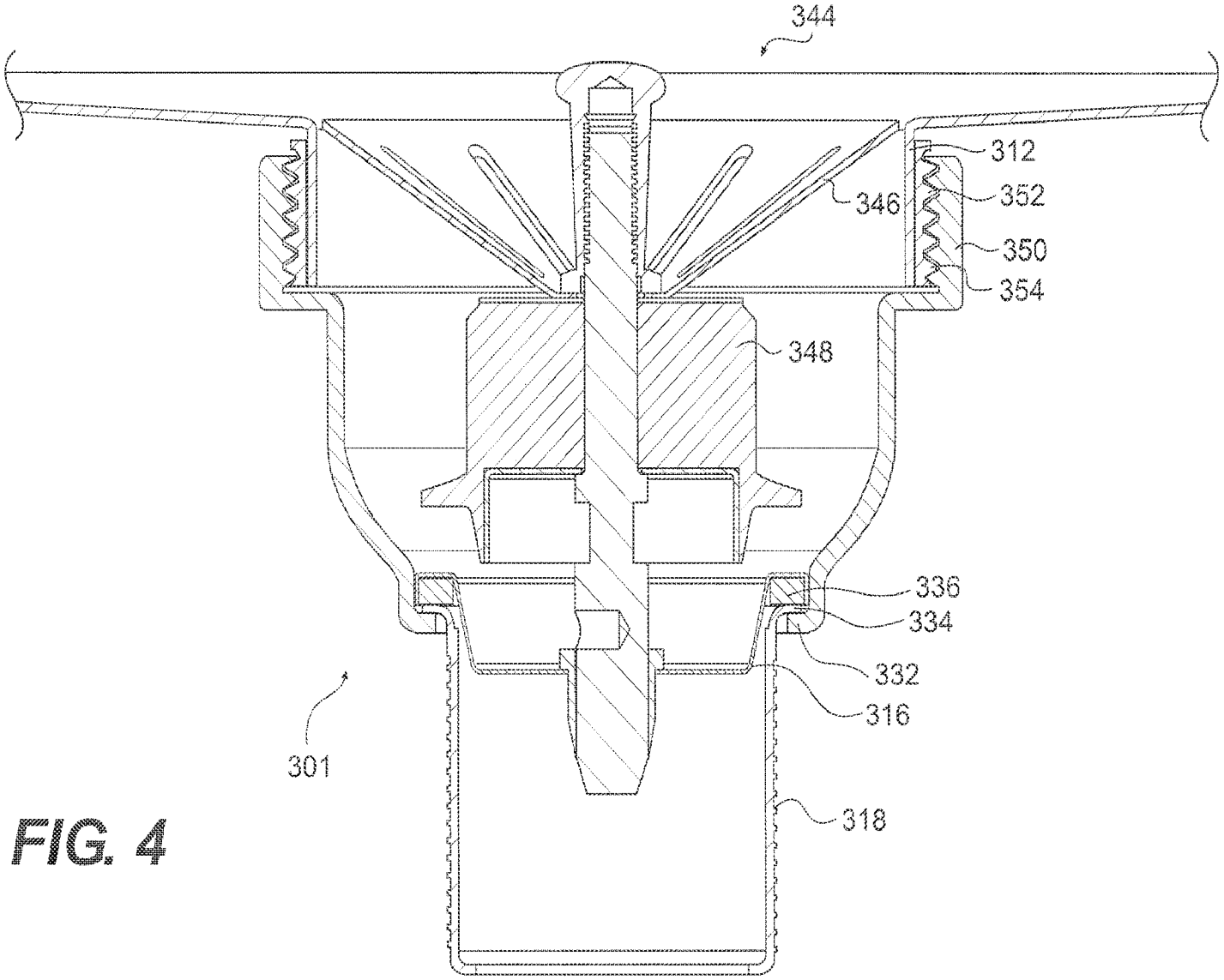
FIG. 4 is a sectional view of a third embodiment of a drain for the sink of FIG. 1.

Referring to FIG. 4, a third embodiment of a drain 301 is shown that can include a drain entry portion 312, an attachment portion 350, and drain elements including a strainer 316, and a drain pipe 318. The drain entry portion 312 can be cylindrical and can extend from the bottom of the sink basin at the opening for the drain 301. In this embodiment, the drain entry portion 312 can be formed from the sink basin during the drawing process to shape the sink. Thus, the drain entry portion 312 can be integrally formed to lead directly from the sink basin to the drain 301. Threads 352 can be welded or otherwise attached to the drain entry portion 312.

The attachment portion 350 can have a threaded surface 354 and an inner edge portion 332. The attachment portion threaded surface 354 can be received and tightened to the threads 352 of the drain entry portion 312. The inner edge portion 332 of the attachment portion 350 can receive a lip 334 of the drain pipe 318 for supporting the drain pipe 318.

The strainer 316 can be disposed above the lip 334 of the drain pipe 318 and the inner edge portion 332 of the attachment portion 350. The strainer 316 can include a seal 336 for contacting the lip 334 of the drain pipe 318 and preventing the passage of water in the drain 301 past the seal. The strainer 316 can be press fit within the attachment portion 350. The strainer 316 can have one or more openings in the bottom of the strainer to permit water to flow past the strainer 316 and into the drain pipe 318. The drain pipe 318 can be threaded to receive a coupler that can be used to attach the drain pipe to a pipe leading to a trap.

A removeable strainer basket 344 can be disposed within the drain 301. The strainer basket 301 can include a basket portion 346 for capturing solids and a stopper 348 that can be lowered into the strainer 316 to plug the drain 301.

Figure 5:
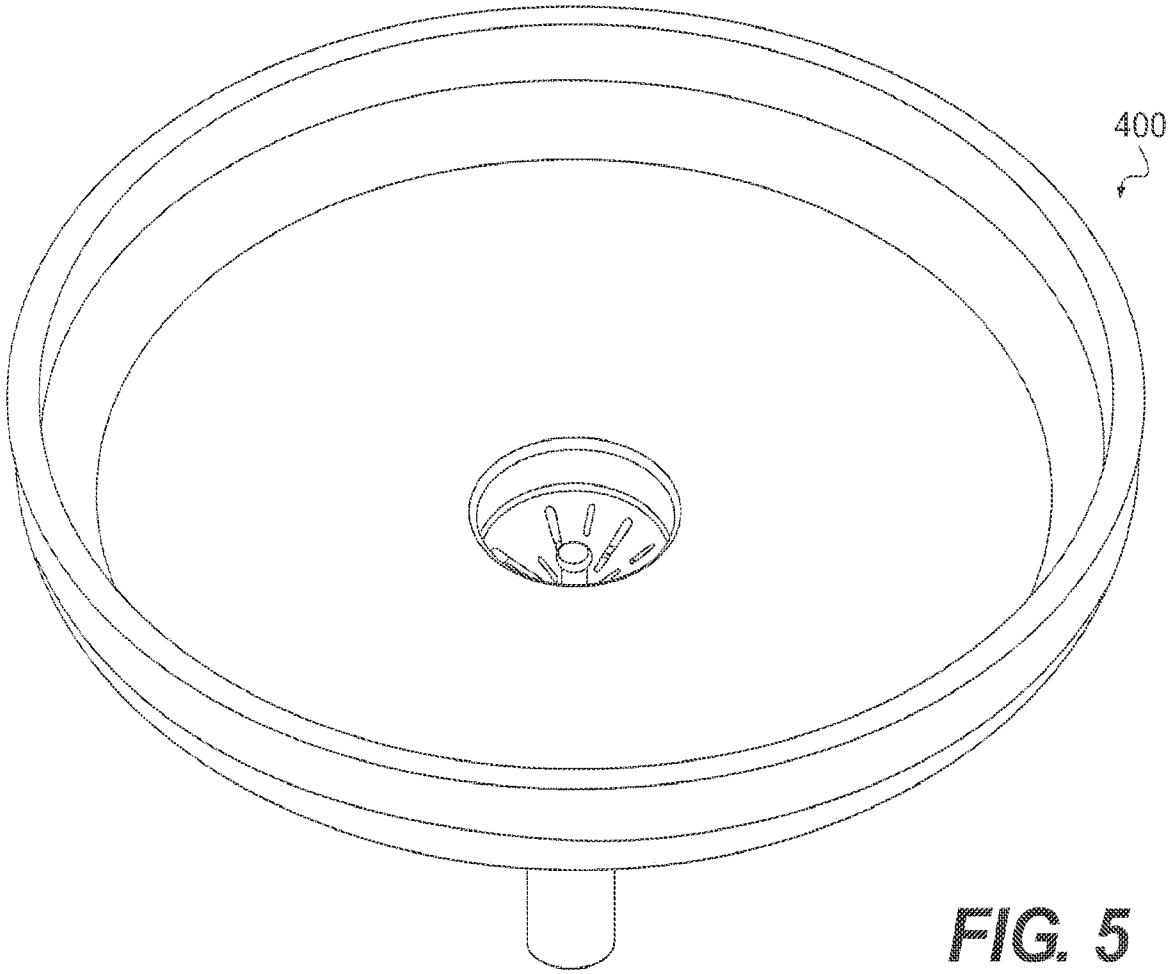
FIG. 5 is a perspective view of another embodiment of a sink.
Figure 6:
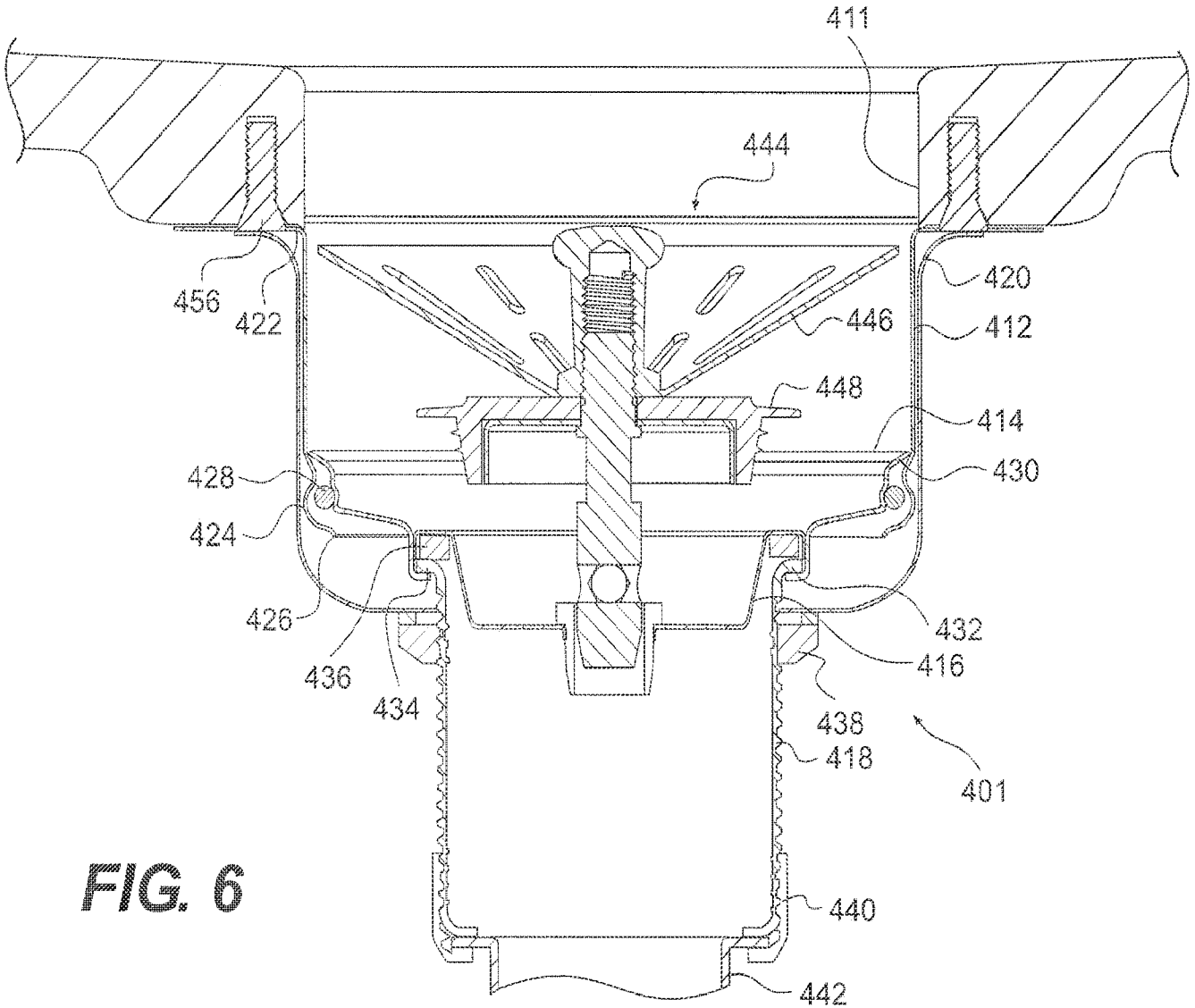
FIG. 6 is a sectional view of an embodiment of a drain for the sink of FIG. 5.

FIGS. 5 and 6 show another embodiment of an edgeless drain 401 suitable for use with a non-metallic sink 400, such as a sink made of granite or other suitable stone. The drain 401 can include a first drain entry portion 411, a second drain entry portion 412, and drain elements including a flange plate 414, a strainer 416, a drain pipe 418, and a cover 420. The first drain entry portion 411 can be cylindrical and can extend from the bottom of the sink basin at the opening for the drain 401. Similar to the embodiment of FIG. 4, the first drain entry portion 411 can be formed as part of the sink basin during the process of making the sink. Thus, the first drain entry portion 411 leads directly from the sink basin into the drain 401.

The second drain entry portion 412 can include a first end portion 422 and a second end portion 424. The second drain entry portion 412 can be a component separately manufactured from the sink. The first end portion 422 of the second drain entry portion 412 can include one or more apertures such that the drain entry portion 412 can be fastened to the bottom of the sink using suitable fasteners 456 disposed through the apertures, such as one or more screws.

The second end portion 424 of the second drain entry portion 412 can include a lip 426 for receiving a seal 428. The flange plate 414 can have an outer edge portion 430 and an inner edge portion 432. The outer edge portion 430 of the flange plate 414 can rest on the seal 428 such that the seal 428 prevents water inside the drain 401 from passing between the intersection of the second drain entry portion 412 and the flange plate 414. The inner edge portion 432 of the flange plate 414 can receive a lip 434 of the drain pipe 418 for supporting the drain pipe 418.

The strainer 416 can be disposed above the lip 434 of the drain pipe 418 and the inner edge portion 432 of the flange plate 414. The strainer 416 can include a seal 436 for contacting the lip 434 of the drain pipe 418 and preventing the passage of water in the drain 401 past the seal 436. The strainer 416 can be press fit within the flange plate 414. The strainer 416 can have one or more openings in the bottom of the strainer to permit water to flow past the strainer 416 and into the drain pipe 418.

The drain 401 can include a cover 420 over the second drain entry portion 412, the flange plate 414, and the strainer 416. The cover 420 can be secured to the sink with a locking nut 438. The drain pipe 418 can be threaded to receive the locking nut 438, and the locking nut 438 can be tightened to enhance the seal force applied between the second drain entry portion 412 and the flange plate 414. A coupler 440 can be used to attach the drain pipe 418 to a pipe 442 leading to a trap.

A removeable strainer basket 444 can be disposed within the drain 401. The strainer basket 444 can include a basket portion 446 for capturing solids and a stopper 448 that can be lowered into the strainer 416 to plug the drain 401.

Figure 7:
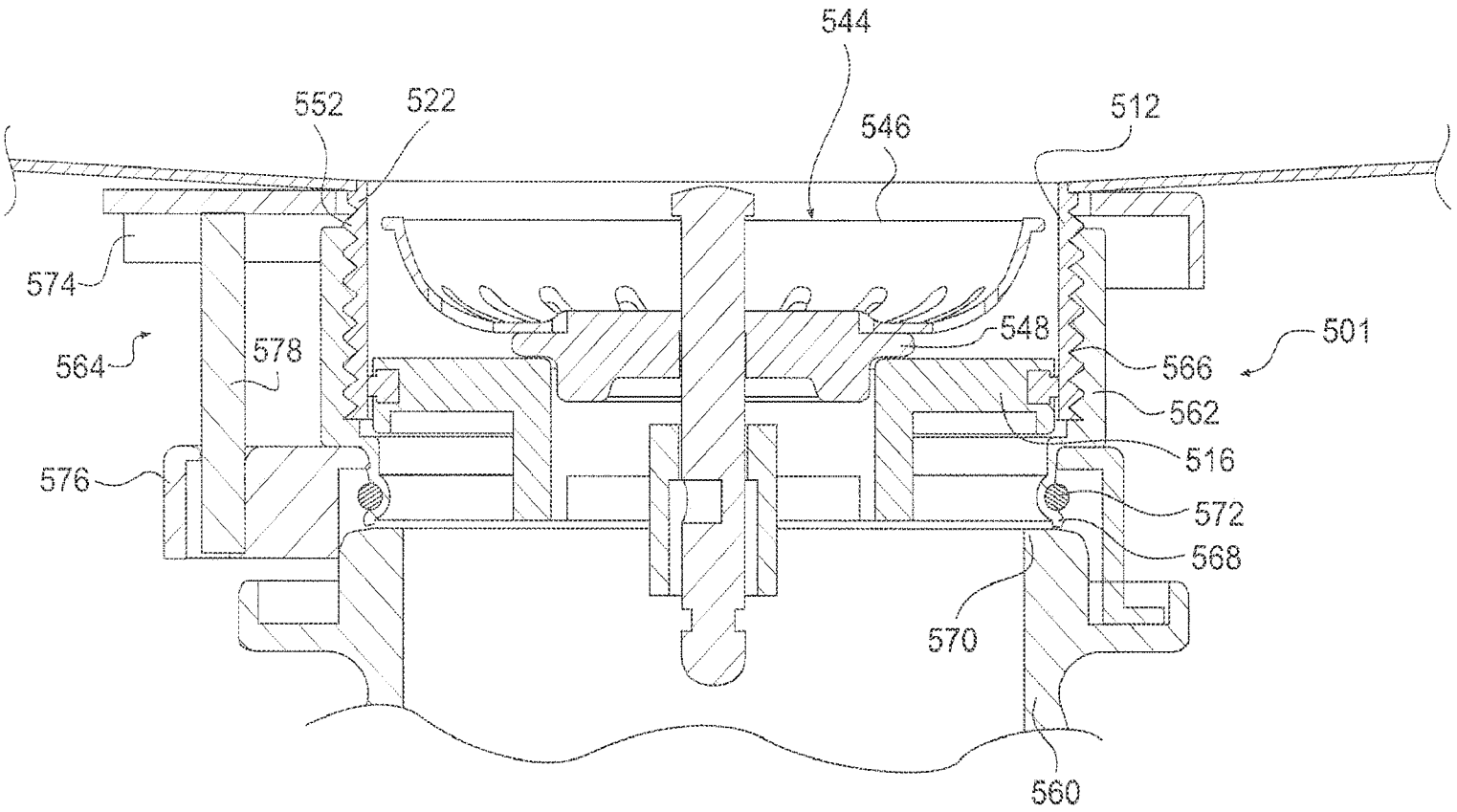
FIG. 7 is a sectional view of an embodiment of a drain for a sink attached to a garbage disposer.
Figure 8:
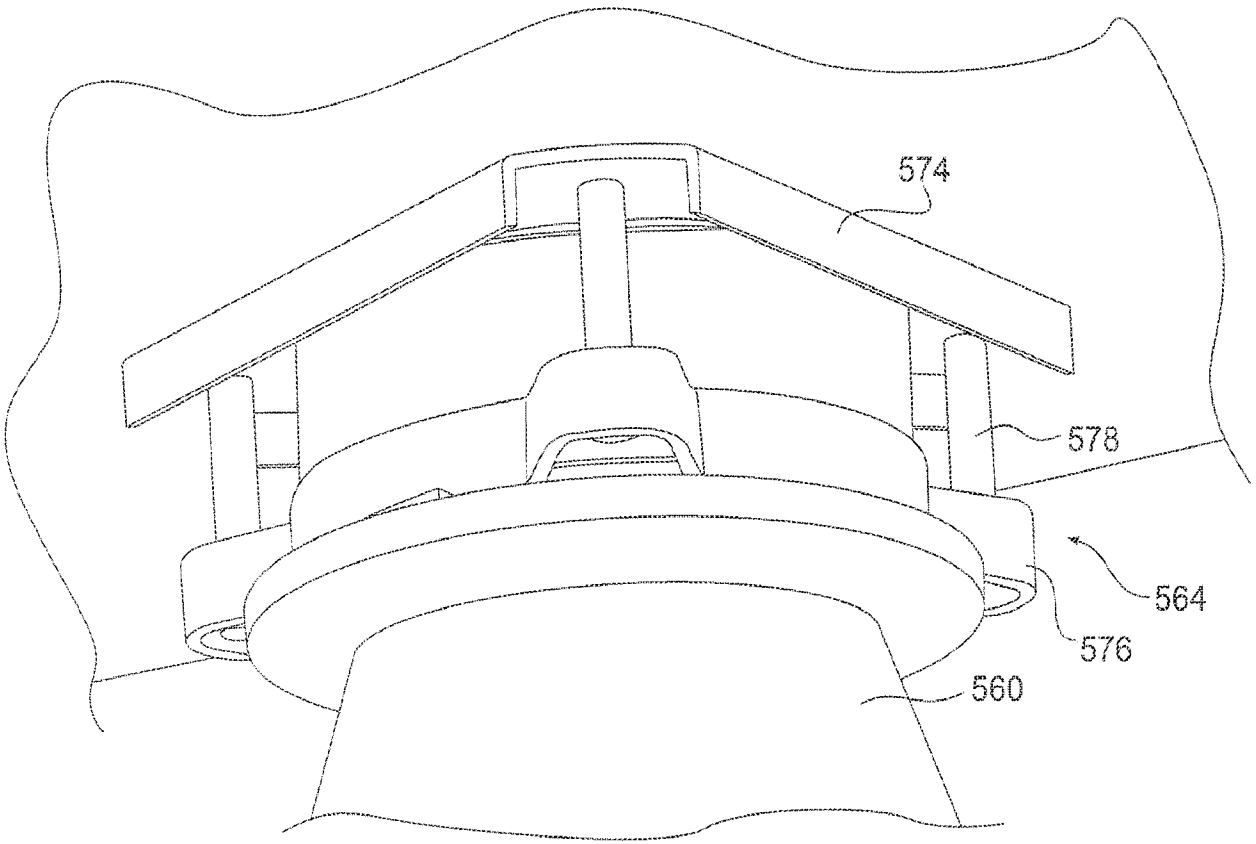
FIG. 8 is a fragmentary bottom perspective view showing the drain of FIG. 7.

It will be appreciated that the above-described sink and drain embodiments may be utilized with a garbage disposer. For example, FIGS. 7 and 8 show an embodiment of a drain 501 attached to a garbage disposer 560. In this embodiment, the drain 501 can include a drain entry portion 512, a disposer attachment ring 562, a strainer 516, and a disposer assembly 564. The drain entry portion 512 can be cylindrical and can extend from the bottom of the sink basin at the opening for the drain 501. The drain entry portion 512 can include a first end portion 522 and a threaded exterior surface 552. The drain entry portion 512 can be a component separately manufactured from the sink. The first end portion 522 of the drain entry portion 512 can be welded to the base to fix the drain entry portion 512 to the sink basin at the opening. In order to conceal the welded intersection between the drain entry portion 512 and the base, a grinding and polishing operation can be applied such that the intersection is hidden to a user looking into the sink basin. In addition, because the drain entry portion 512 can be mounted from below without the need for a drain rim to rest on the base, there is no groove between the drain 501 and the sink basin. From a user's perspective, the drain opening leads directly into the drain 501. The weld between the sink basin and the drain entry portion 512 can be accomplished in any suitable manner, such as with a shielding gas weld.

The disposer attachment ring 562 can have a threaded surface 566 and a lower portion 568. The flange plate threaded surface 552 can be received and tightened to the threaded exterior surface 566 of the drain entry portion 512. The lower portion 568 can have a detent 570 for receiving a snap ring 572. The strainer 516 can be disposed above detent 570. The strainer 516 can have one or more openings in the bottom of the strainer to permit water to flow past the strainer 516 and into the disposer 560.

The disposer assembly 564 can include a backup flange 574 and a mounting ring 576. The backup flange 574 can be generally triangular and the mounting ring 576 can have a plurality of tightening screws 578 for contacting the backup flange 574 near each vertex of the backup flange 574. During tightening of the screws 578, the mounting ring 576 can be retained to the disposer attachment ring 562 by the snap ring 572. As is known to those of skill in the art, the disposer 560 can include a bracket for hanging the disposer from the mounting ring.

A removeable strainer basket 544 can be disposed within the drain 501. The strainer basket 544 can include a basket portion 546 for capturing solids and a stopper 548 that can be lowered into the strainer 516 to plug the drain 501.

Figure 12:
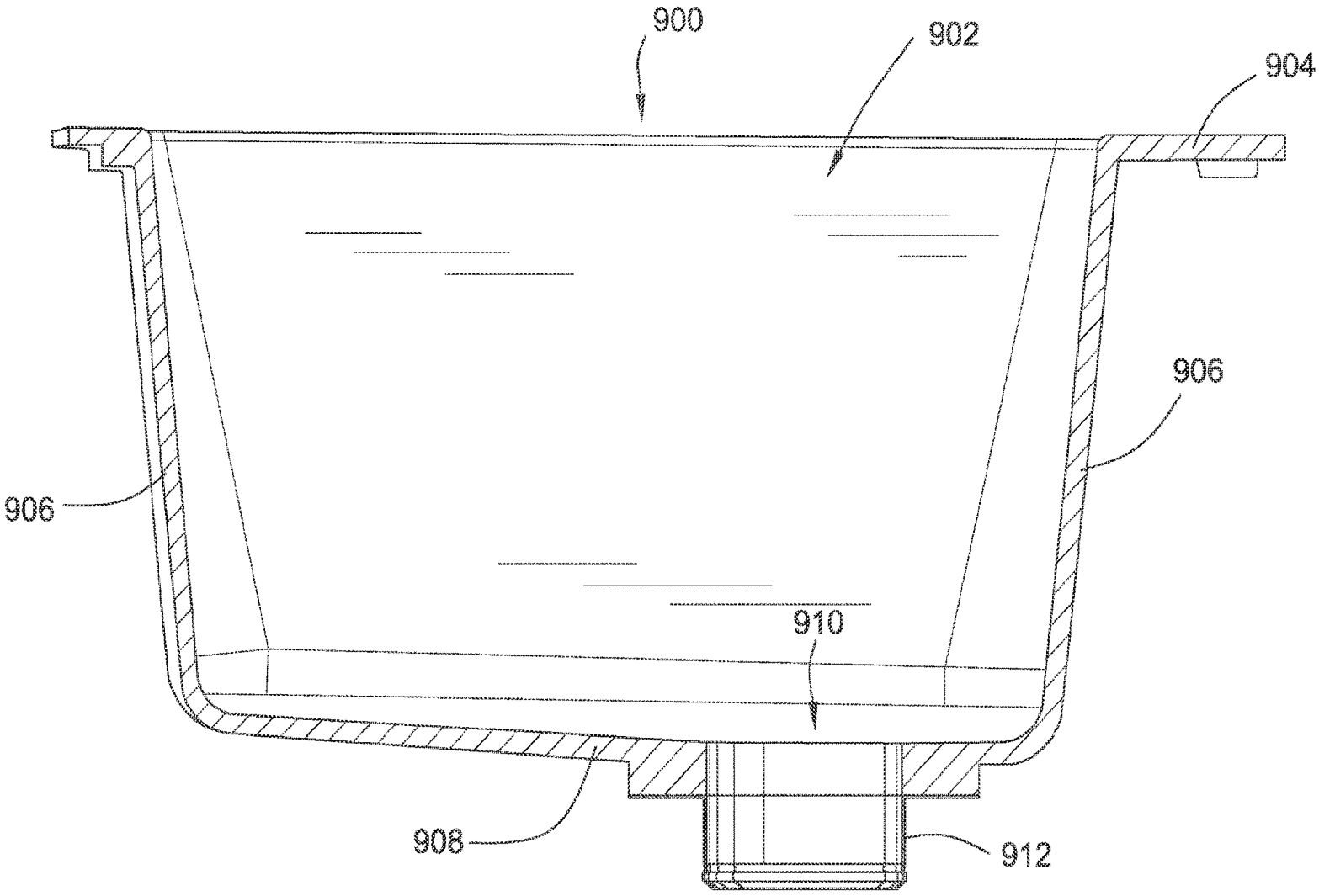
FIG. 12 is a cross section view of a sink.

FIGS. 12-21 show a variety of alternative sink/drain attachment embodiments. In particular, sinks constructed of composite materials that are cast or molded, such as E-Granite™ and other similar materials, are particularly well suited to the illustrated attachment embodiments. One such sink 900 is shown in FIG. 12 with the configuration of an edgeless drain. Other similar sink configurations are contemplated. The sink 900 can include one or more sink basins 902 and a rim 904. The sink basin 902 can include one or more sidewalls 906 and a base 908. The base 908 can include an opening 910 for a drain. The sidewalls 906 and base 908 can form an interior surface of the basin 902 to retain water and washable items. The rim 904 can be used to support the basin 902 in an above-mount arrangement or under-mount arrangement with respect to a counter. The sink 900 can be made of any suitable material, such as a composite stone and acrylic resin matrix. One advantage of such an engineered, molded product is that the area surrounding the opening 910 may be provided with an increase in material thickness relative to the sidewalls 906, which is sufficiently thick to receive fasteners or other fastening elements as will be described in more detail hereinbelow in order to fasten a drain entry portion 912 of a drain thereto. For clarity, many of the elements of the drain will be omitted in the following illustrations, and it will be understood that the drain elements shown in the previous drawings and described above may be used in conjunction with the drain entry portion 912 shown in FIG. 13, and similar elements in the following embodiments labeled as element 1212, 1312, 1412, or 1512, for example.

Figure 13:
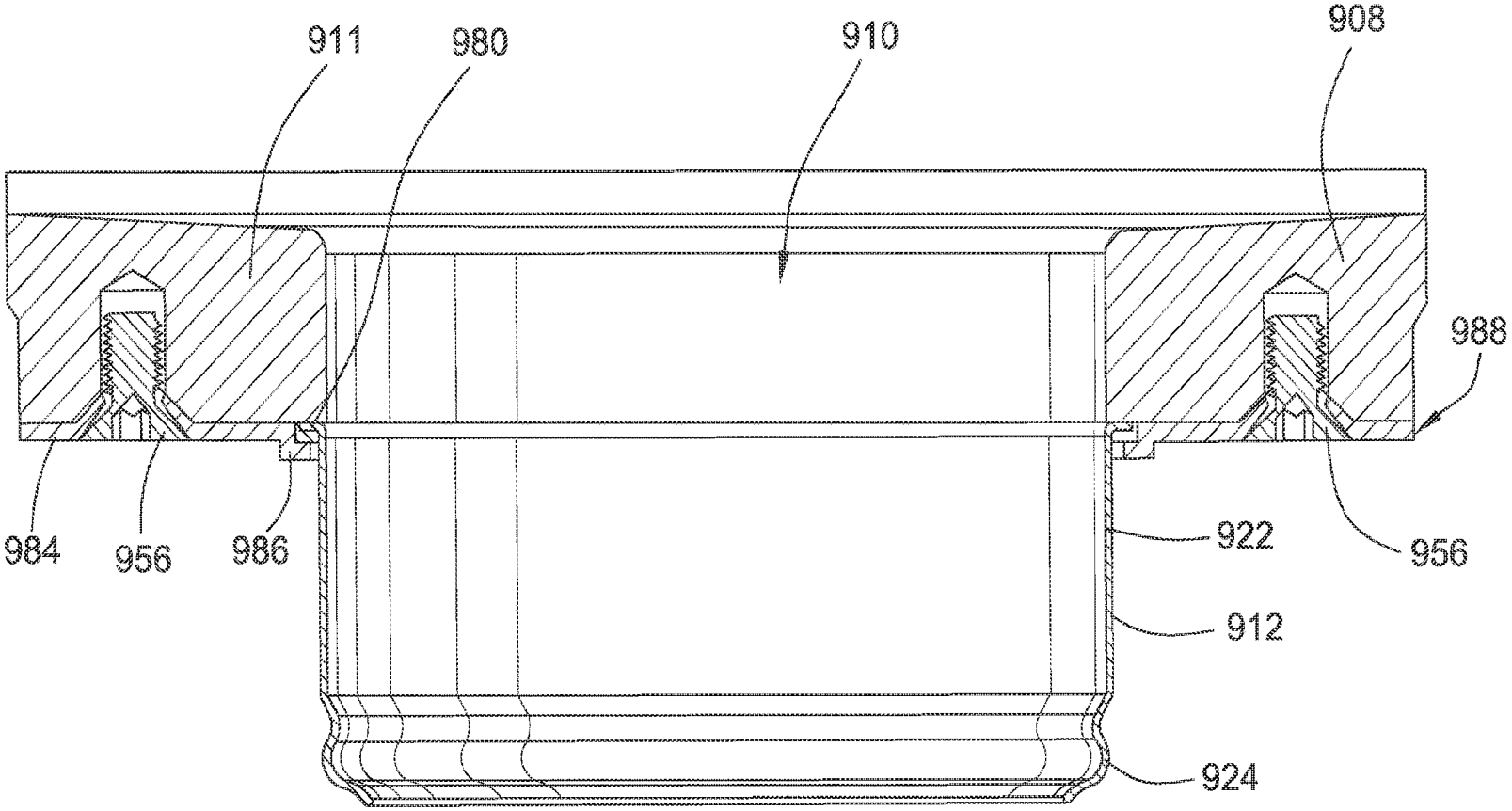
FIG. 13 is a sectional close up view of a drain of the sink of FIG. 12.

FIG. 13 shows a portion of a sink base 908 according to the embodiment of FIG. 12. The base 908 includes an opening 910, which is formed in a portion of the base that is thicker relative to the surrounding material. The thickened section of the base 908 is drilled and tapped or otherwise provided with threads or the like to receive fasteners 956, which may be threaded screws. The fasteners 956, when installed, hold a bracket 984 in position against the underneath of the base 908 surrounding the opening 910. The bracket 984 may be circular, rectangular, or any suitable shape. An optional gasket 988 may be installed between the base 908 and the bracket 984. The bracket 984 includes a lip 986 that defines, with the base 908, an annular channel or groove.

The sink 900 includes a first drain entry portion 911 and a second drain entry portion 912 sized and shaped to receive drain elements, some examples of which are set out in the above embodiments. The second drain entry portion 912 includes a first end portion 922 that is positionable adjacent the base 908 and a second end portion 924 that is at an opposite end of the first end portion. The second drain entry portion 912 is similar in construction, shape and size as the second drain entry portion 412 in FIG. 6. The first end portion 922 includes a radially outwardly extending flange 980. The diameter of the second drain entry portion 912 may match or be about that of the diameter of the opening 910. The flange 980 extends radially outwardly from the first end portion 922. The second drain entry portion 912 is held in position on the base 908 by the overlapping interconnection of the flange 980 and the lip 986.

Connection of the second drain entry portion 912 to the sink 900 proceeds by positioning the second drain entry portion on the underside of the base 908 of the sink. The bracket 984 is positioned over the second drain entry portion 912 with the flange 980 overlappingly captured by the lip 986. The fasteners 956 are screwed or otherwise secured into bores formed in the base 908 to retain the bracket 984 on the base. Alternatively, a gasket 988 may be interposed between the base 908 and the bracket 984 to provide sealing.

Figure 14:
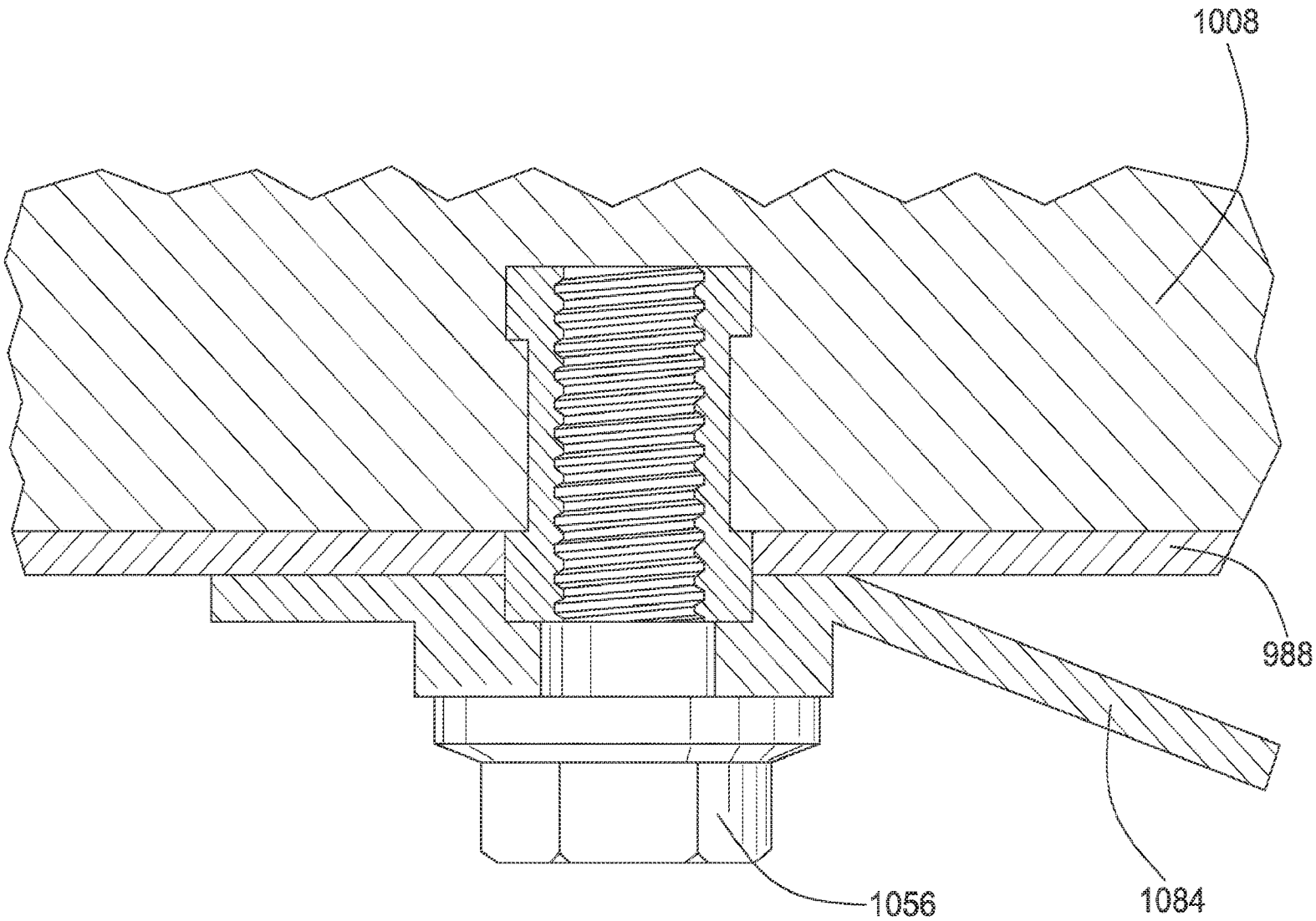
FIG. 14 is a sectional close up view of an embodiment of a fastener for attaching a drain to a sink.

While the fasteners 956 may directly threadably engage the material of the base 908, other types of fasteners are contemplated. For example, as shown in FIG. 14, the base 1008 is modified to receive an undercut anchor-type fastener 1056. The fastener 1056 includes a receiving part that resides embedded within the material of the base 1008 and a bolt that threads into the receiving part. The fastener 1056 holds gasket 988 and bracket 1084 in a similar fashion as the fastener shown in FIG. 13. The illustrated fastener 1056 is a commercially anchor available from Keil®. Preparation of the base 1008 for fastener 1056 is a well-known process.

Figure 15:
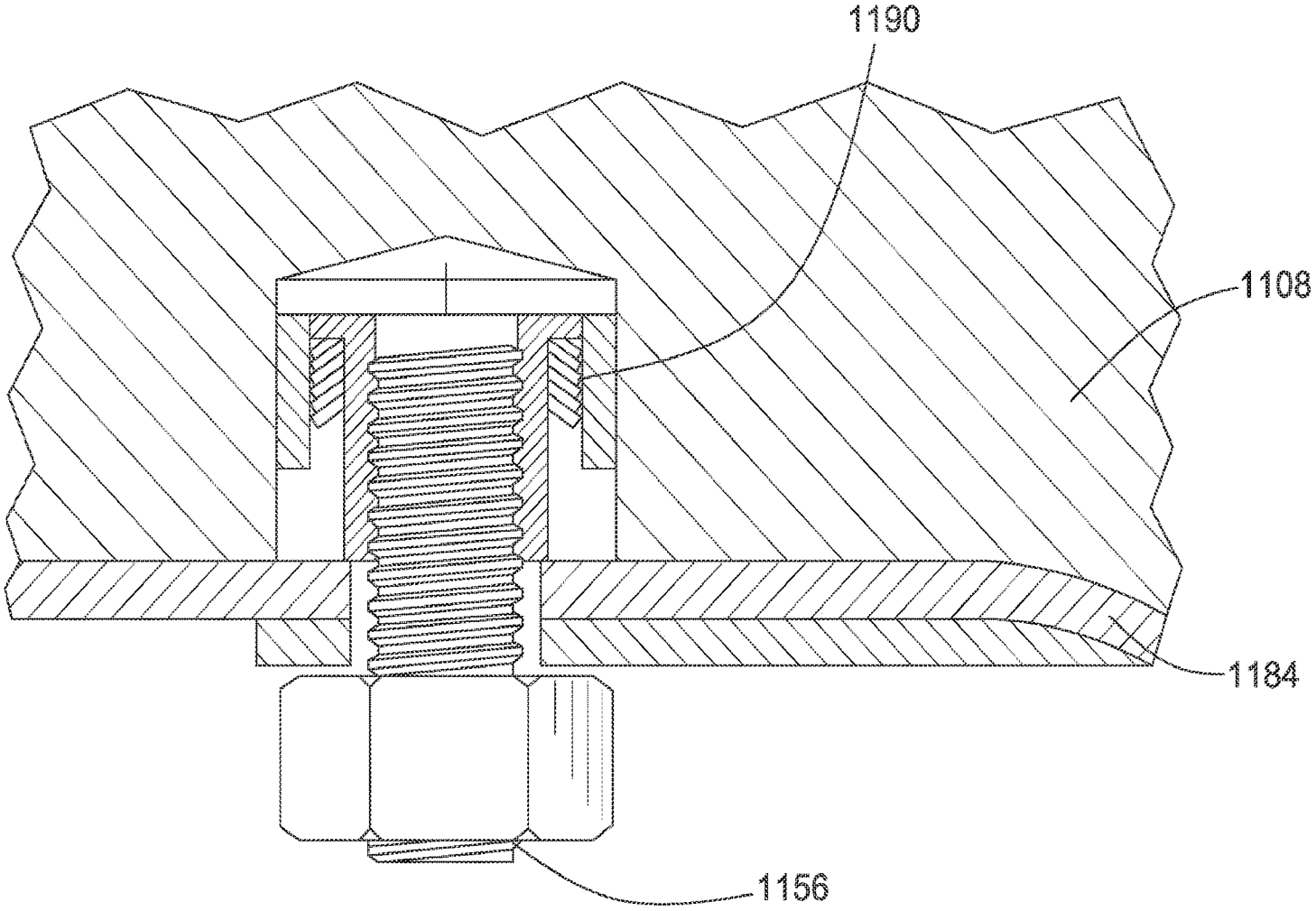
FIG. 15 is a sectional close up view of another embodiment of a fastener for attaching a drain to a sink.

Another type of fastener is shown in FIG. 15. In this embodiment, the base 1108 may be provided with straight sided bores to receive a press-in threaded anchor 1190 that receives a bolt and nut fastener 1156. This type of anchor/fastener is commercially available from Specialinsert® and holds bracket 1184 in a similar fashion as the fastener shown in FIGS. 13 and 14.

Figure 16:
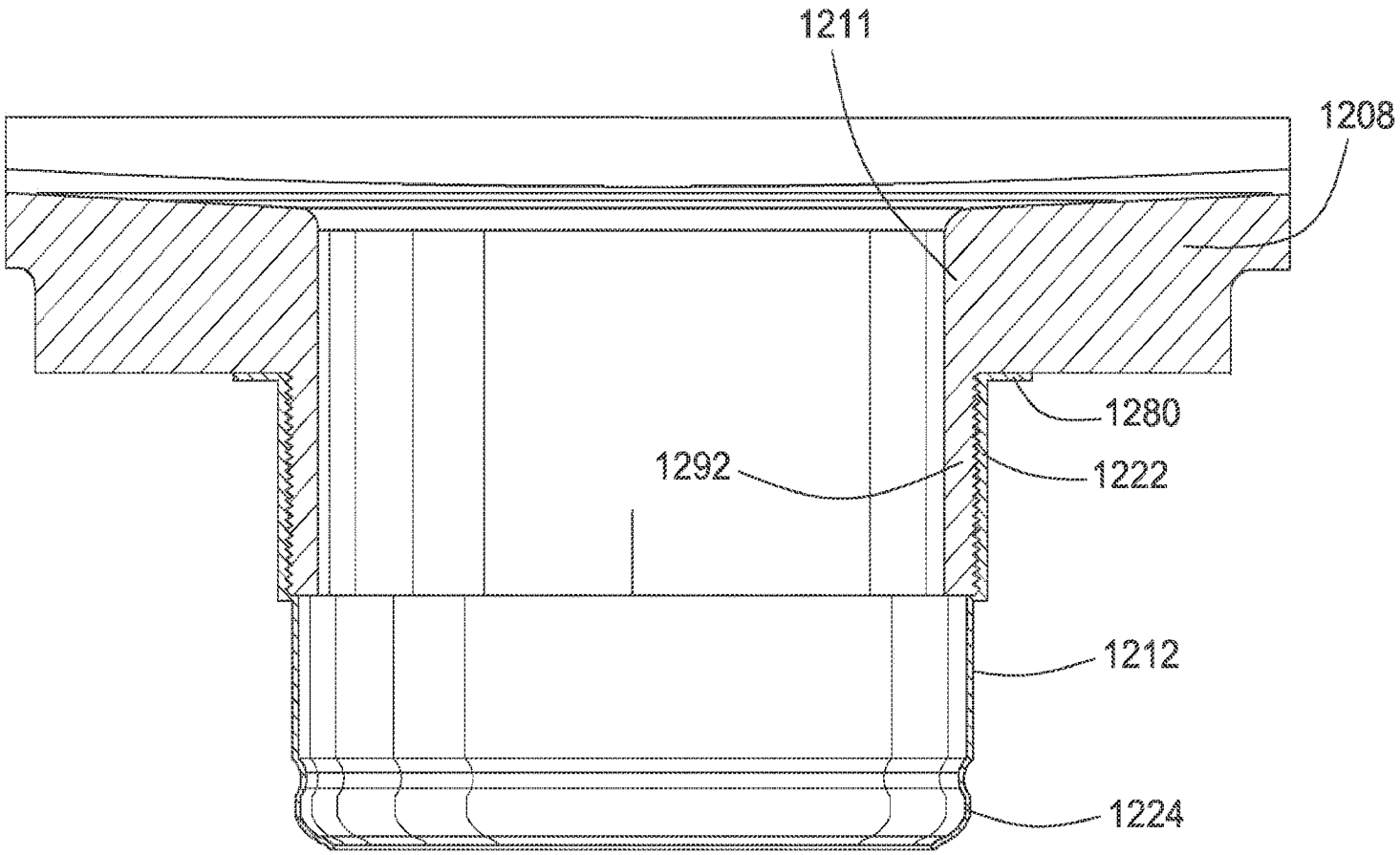
FIG. 16 is a sectional close up view of yet another embodiment of a configuration for attaching a drain to a sink.

Turning to FIG. 16, the first drain end portion 1211 is shown formed with an externally threaded extension 1292 that extends downwardly from the base 1208. The second drain entry portion 1212 includes a first end portion 1222 with internal threads that are shaped and sized to threadably engage the externally threaded extension 1292. A second end portion 1224 is configured as in previous embodiments. Installation of the second drain entry portion 1212 proceeds by threading the first end portion 1222 of the second drain entry portion onto the externally threaded extension 1292 until the flange 1280 abuts the bottom of the base 1208.

Figure 17:
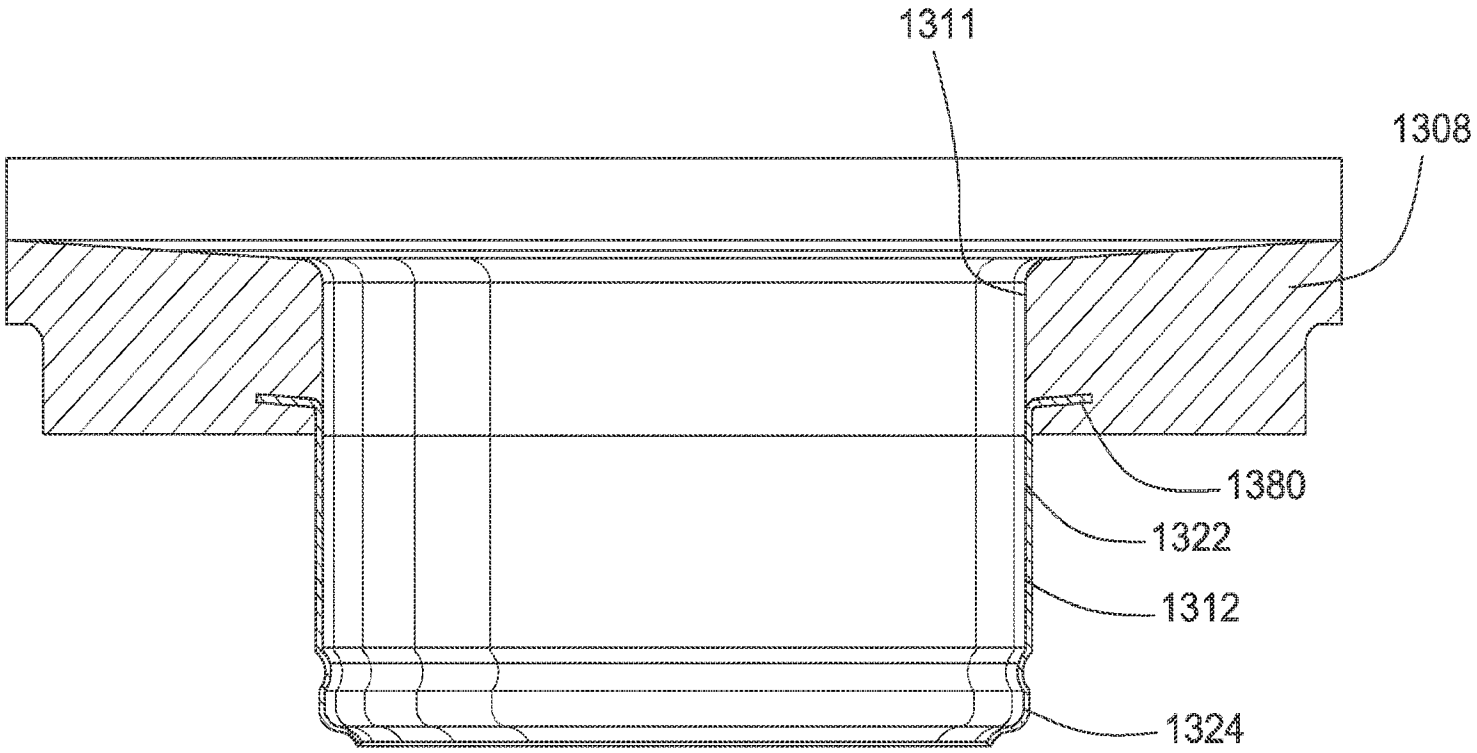
FIG. 17 is a sectional close up view of yet another embodiment of a configuration for attaching a drain to a sink.

FIG. 17 shows a sink base 1308 with a first drain entry portion 1311 and a second drain entry portion 1312. The second drain entry portion 1312 includes a first end portion 1322 with a radially extending flange 1380 and a second end portion 1324 opposite the first end portion. The flange 1380 is embedded in the material of the first drain entry portion 1311 of the base 1308. The embedding may occur during manufacture of the sink base. For example, the flange 1380 may be inserted into a mold or fixture used to case the sink base prior to casting such that the cast material may flow around portions of the flange 1308.

Figure 18:
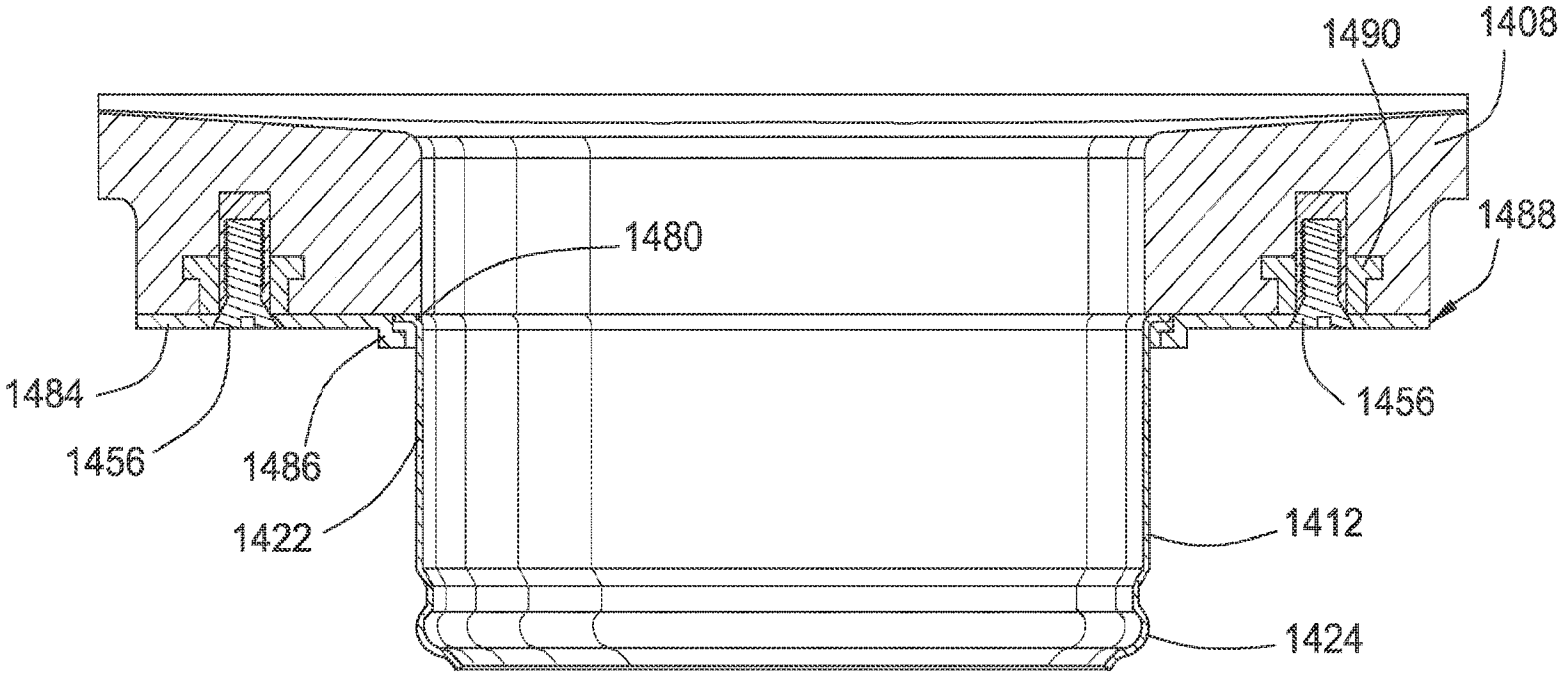
FIG. 18 is a sectional close up view of yet another embodiment of a fastener for attaching a drain to a sink.

FIG. 18 shows yet another fastener 1456 comprising a flange nut 1490 and mounting screw 1456. The flange nut 1490 is cast or embedded into the material of the base 1408 and resides within the material permanently as a result of its shape. The second drain entry portion 1412 is held in position on the underneath surface of the base 1408 by the interconnection of the flange 1480 of the first end portion 1422 and the lip 1486 located on the bracket 1484. The mounting screw 1456 holds the bracket 1484 to the underneath of the base 1408 with an optional gasket 1488 interposed between the bracket and base.

Figure 19:
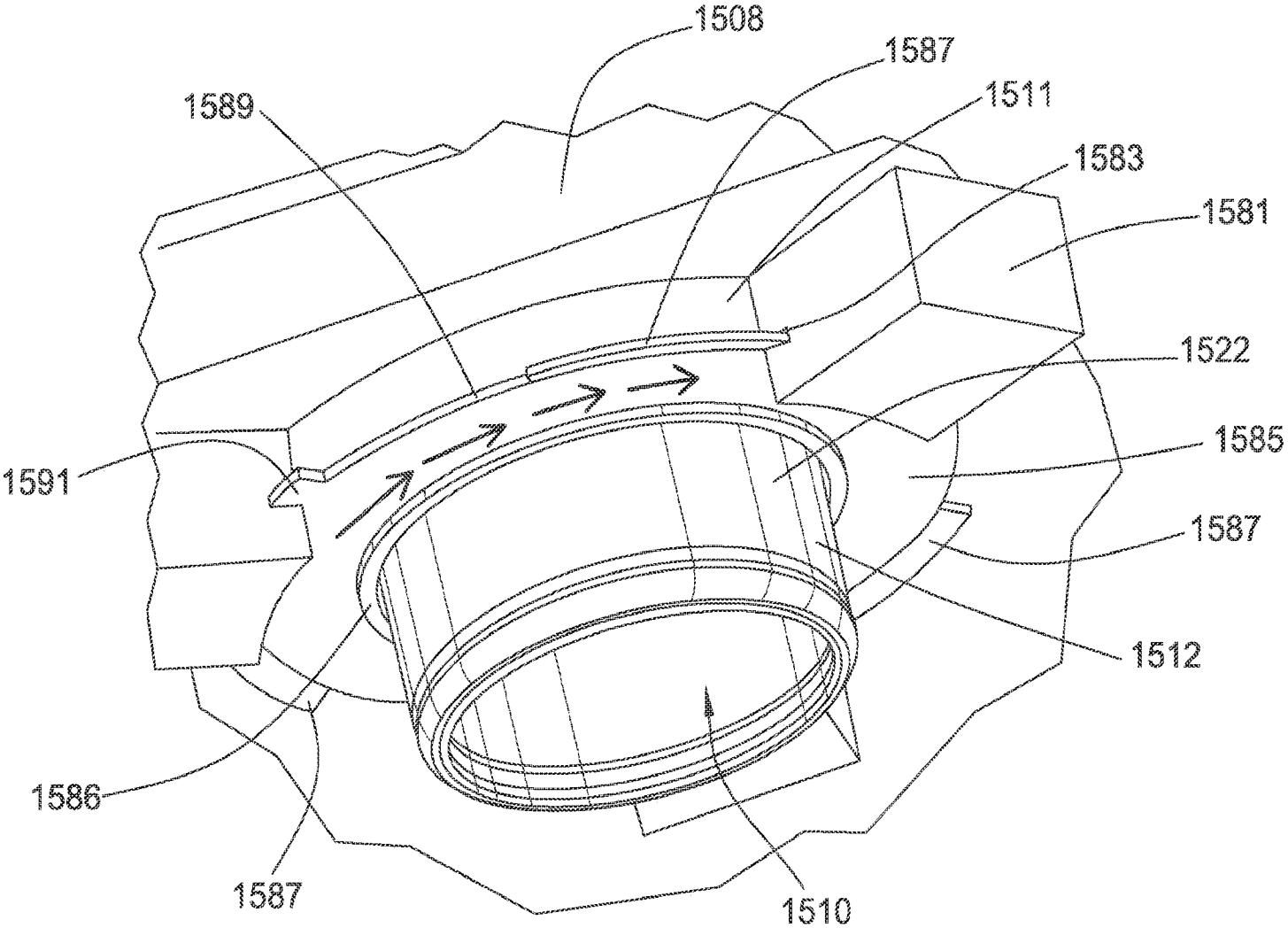
FIG. 19 is a perspective close up view of yet another embodiment of a configuration for attaching a drain to a sink.
Figure 20:
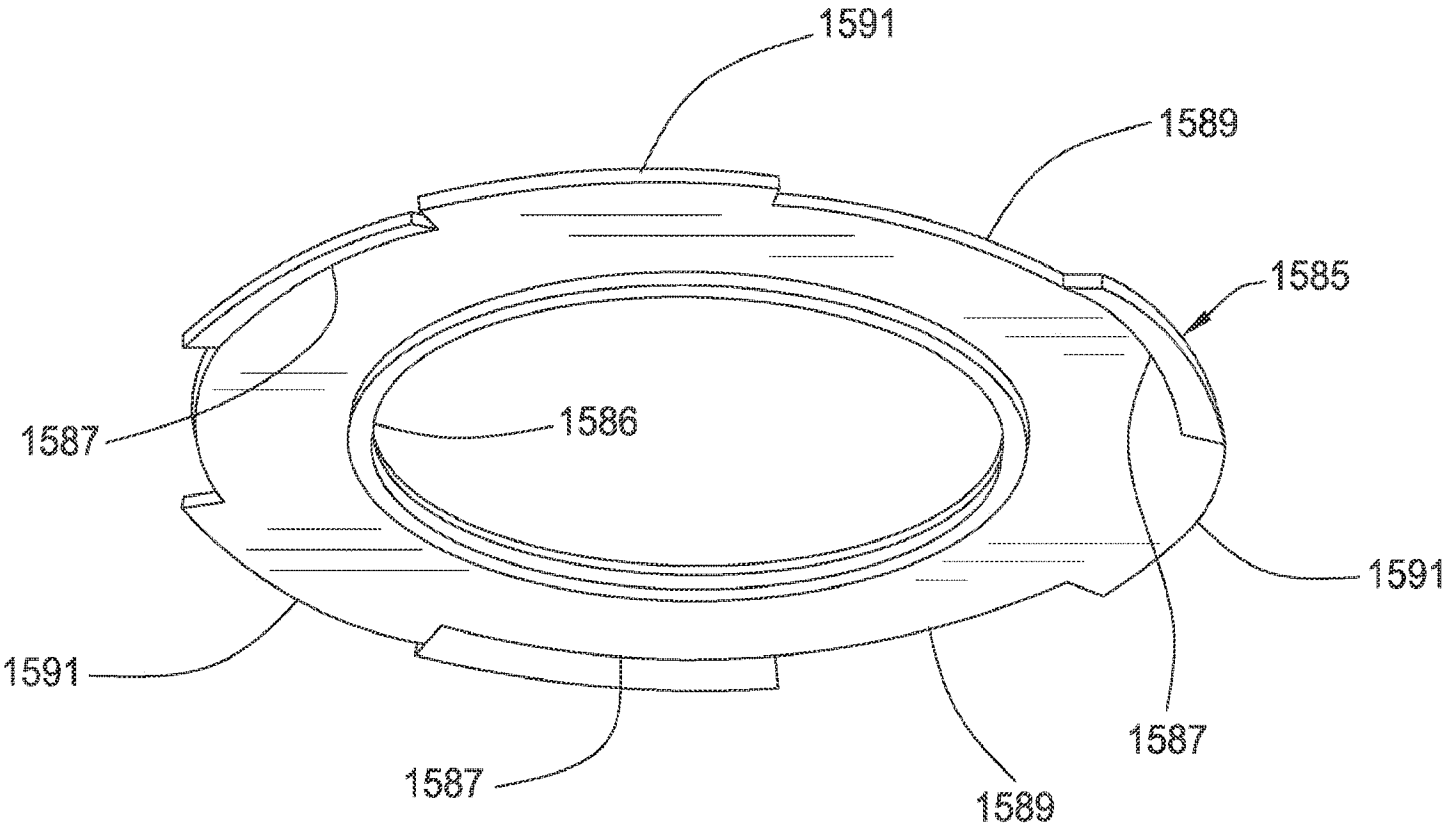
FIG. 20 is a perspective view of a portion of the configuration of FIG. 19.

FIGS. 19-20 show yet another mechanism and method of connecting a second drain entry portion 1512 via a first end portion 1522 to a sink basin 1508. The sink basin 1508 includes a first drain entry portion 1511 defining an opening 1510 provided with three or more spaced blocks 1581 surrounding the opening. The spaced blocks 1581 are formed with radially inwardly facing notches 1583. The spaced blocks 1581 may be formed as a unitary, one-piece construction with the sink or attached to the sink basin 1508 with an adhesive, for example. The notches 1583 may be provided via other features formed in or attached to the basin 1508.

A locking bracket or lockring 1585 is shaped and sized to interconnect and lock to the spaced blocks 1581M a first rotational orientation and disengage from the spaced blocks in a second rotational orientation. The locking function is accomplished by engaging a plurality of spaced lugs 1591 that extend radially outwardly from the bracket 1585. The lugs 1591 are configured to engage with the notches 1583 in the first rotational orientation. The bracket 1585 may be a substantially flat lock ring and includes a lip 1586 shaped and sized to retain the first end portion 1522.

The bracket 1585 includes cutaways 1589 between the lugs 1591. When the cutaways 1589 are aligned with the blocks 1581, no engagement occurs between the bracket 1585 and the blocks and second drain entry portion 1512 can be disassembled from the sink. The bracket 1585 may also include stops 1587 that are formed between the lugs 1591 and the cutaways 1589, which may be angled with respect to the plane of the bracket 1585 and contact the blocks to stop the rotation of the bracket. When the stops 1587 contact the blocks 1581 and rotation of the bracket 1585 is thereby arrested, the installer can be assured that the lugs 1591 are properly and fully engaged in the notches 1583 and the second drain entry portion 1512 is secured to the basin 1508.

During assembly, the first end portion 1522 of the second drain entry portion 1512 is positioned against the underneath of the basin 1508 surrounding the opening 1510. The bracket 1585 is installed over the second drain entry portion 1512 with the cutaways 1589 aligned to clear and pass over the blocks 1581. The lip 1586 overlaps and captures the flange (not shown) of the second drain entry portion 1512. The bracket 1585 is rotated (FIG. 19) so the lugs 1591 are inserted and engage with the notches 1583 into the second rotational orientation shown in FIG. 19. The stops 1587 contact the blocks 1581 to arrest the rotation of the bracket 1585 and provide confirmation that the lugs 1591 are fully engaged, which can occur without the need for visual inspection. Reversing the rotation of the bracket 1585 reverses the installation process and permits disassembly of the drain from the sink.

Figure 21:
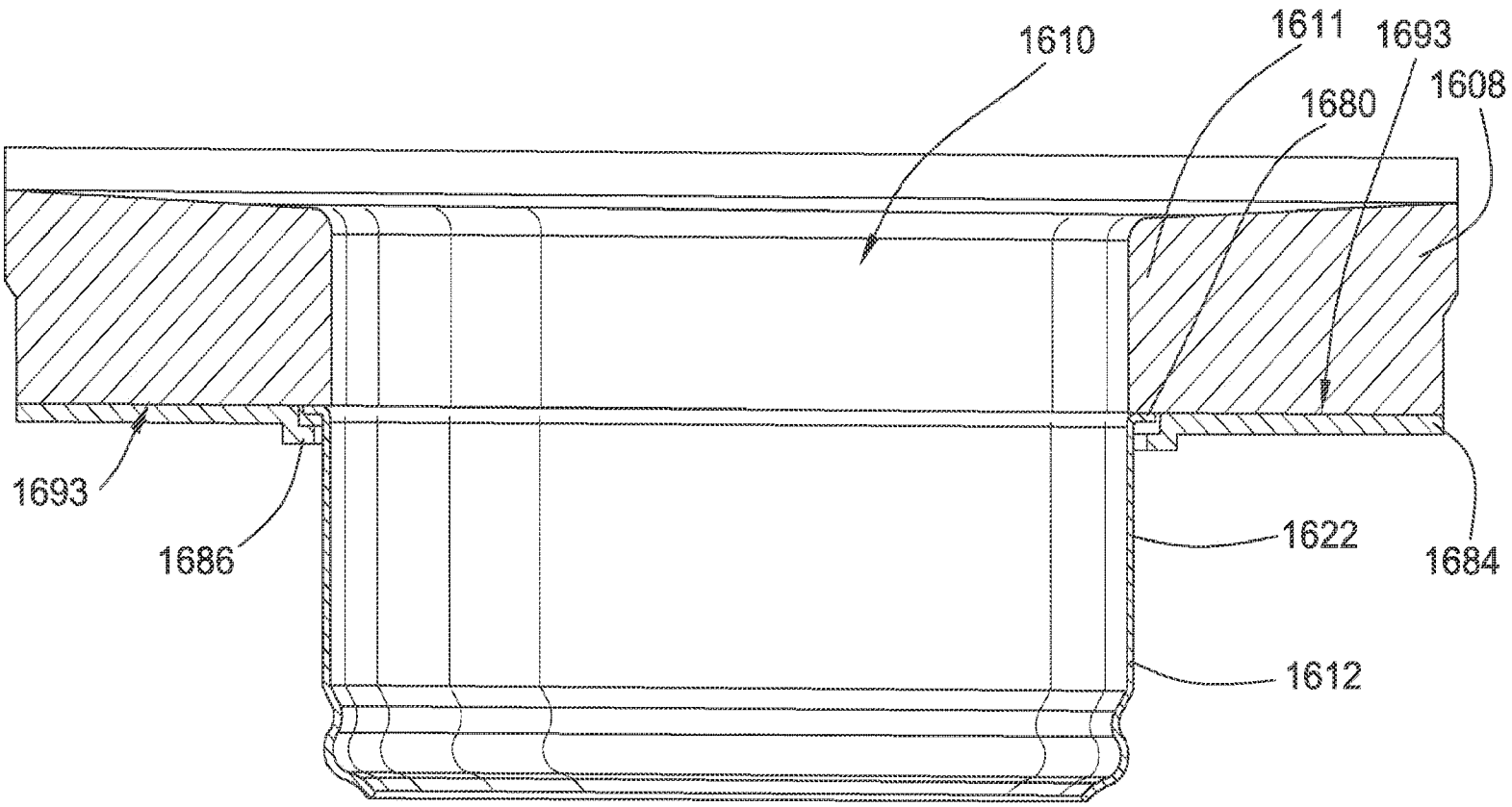
FIG. 21 is a sectional close up view of yet another embodiment of a configuration for attaching a drain to a sink.

FIG. 21 shows another embodiment of a mechanism and method for attaching a drain to a sink. The sink basin 1608 includes an opening 1610 defined by a first drain entry portion 1611. A second drain entry portion 1612 is brought into contact with the underneath the drain basin 1608 by contacting a flange 1680 of a first end portion 1622 of the second drain entry portion to the underneath of the drain basin. A bracket 1684, which is sized and shaped to hold the flange 1680 via a lip 1686 and abut the underneath of the drain basin 1608. An adhesive 1693 is applied to the side of the bracket 1684 in contact with the drain basin 1608, which functions to hold the bracket on the drain basin.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A sink comprising:

a sink basin having a sidewall and a base in a bottom portion thereof, the base including a drain opening;

a first drain entry portion integrally formed from the base and extending from the bottom portion at the drain opening;

a second drain entry portion including a first end portion with a radially outwardly extending flange configured to connect to the base at the first drain entry portion, and a second end portion opposite the first end portion;

a bracket including a lip configured to engage the flange; and a fastener attaching the bracket to the base to thereby hold the first end of the second drain entry portion to the first drain entry portion with the lip engaged with the flange.

2. The sink of claim 1, wherein the bracket is ring-shaped and is sized and shaped to surround the first end portion.

3. The sink of claim 2, wherein the lip is circular and defines an annular space with the bottom portion that is sized and shaped to receive the flange.

4. The sink of claim 1, wherein the fastener includes a threaded fastener.

5. The sink of claim 4, wherein the threaded fastener includes one of a screw and a bolt.

6. The sink of claim 5, further comprising an anchor disposed within a bore of the base, wherein the fastener is threadably received by the anchor to attach the bracket to the base.

7. The sink of claim 6, wherein the anchor is one or more of press-fit, glued, and threaded into the base.

8. The sink of claim 1, further comprising a gasket disposed between the flange and the base.

9. The sink of claim 1, further comprising:

a flange plate having an inner edge portion and an outer edge portion, the inner edge portion forming a drain opening that permits water from the second drain entry portion to flow through the flange plate, the outer edge portion extending to the second drain entry portion;

a first seal formed at a first junction of the outer edge portion of the flange plate and the second drain entry portion;

a drain pipe fluidly connected to the inner edge portion of the flange plate around the drain opening;

a second seal formed at a second junction of the drain pipe and the inner edge portion of the flange plate;

a strainer; and a removable drain basket that includes a stopper, the stopper being selectively placeable between a lowered position, in which the stopper covers the strainer to plug the drain opening, and a raised position, in which water from the second drain entry portion flows around the stopper and through the drain opening.

* * * * *